US011672308B2

(12) United States Patent
Donohoe

(10) Patent No.: US 11,672,308 B2
(45) Date of Patent: Jun. 13, 2023

(54) AUTOLACING FOOTWEAR HAVING A NOTCHED SPOOL

(71) Applicant: NIKE, Inc., Beaverton, OR (US)

(72) Inventor: Brendan Donohoe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 506 days.

(21) Appl. No.: 16/557,286

(22) Filed: Aug. 30, 2019

(65) Prior Publication Data

US 2020/0068999 A1 Mar. 5, 2020

Related U.S. Application Data

(60) Provisional application No. 62/725,677, filed on Aug. 31, 2018.

(51) Int. Cl.

| | |
|---|---|
| ***A43C 11/16*** | (2006.01) |
| ***A43C 11/00*** | (2006.01) |
| ***A43C 1/04*** | (2006.01) |

(52) U.S. Cl.

CPC ..... *A43C 11/165* (2013.01); *A43C 1/04* (2013.01); *A43C 11/008* (2013.01)

(58) Field of Classification Search

CPC ..... A43C 11/165; A43C 11/008; A43C 11/00
See application file for complete search history.

(56) References Cited

U.S. PATENT DOCUMENTS 431,737 A * 7/1890 Bertrand ..... A43C 1/00 24/713.3

4,922,634 A * 5/1990 Seidel ..... A43B 3/34 36/117.8

(Continued)

FOREIGN PATENT DOCUMENTS

| | | |
|---|---|---|
| CN | 1887133 | 1/2007 |
| CN | 102014682 | 4/2011 |

(Continued)

OTHER PUBLICATIONS

"European Application Serial No. 19856247.2, Response filed Oct. 21, 2021 to Communication Pursuant to Rules 161 and 162 EPC", 12 pgs.

(Continued)

*Primary Examiner* — F Griffin Hall
*Assistant Examiner* — Raquel M. Weis
(74) *Attorney, Agent, or Firm* — Schwegman, Lundberg & Woessner, P.A.

(57) ABSTRACT

An article of footwear and related method includes a midsole, an upper secured with respect to the midsole, and a lace extending across the upper, the lace having a securing member, a first segment of the lace having a first apparent length and a second segment of the lace, separated from the first segment by the securing member, having a second apparent length. A motorized lacing system is configured to engage with the lace to increase and decrease tension on the lace. The motorized lacing system includes a motor and a spool, coupled to the motor, configured to spool and unspool the lace, the spool having a plurality of notches, each of the plurality of notches configured to seat the securing member, wherein the first apparent length and the second apparent length is adjustable based on which of the plurality of notches the securing member is seated in.

14 Claims, 7 Drawing Sheets

(56) References Cited

U.S. PATENT DOCUMENTS 4,999,889 A * 3/1991 LeCouturer ..... A43C 1/06 24/713.2
6,032,387 A * 3/2000 Johnson ..... A43C 11/16 36/118.1
6,467,194 B1 * 10/2002 Johnson ..... A43C 1/06 36/118.1
6,896,128 B1 * 5/2005 Johnson ..... A43C 11/165 36/118.1
7,721,468 B1 * 5/2010 Johnson ..... A43C 1/06 36/118.1
8,832,913 B2 * 9/2014 Kajiwara ..... A43C 9/00 24/715.3
8,904,672 B1 * 12/2014 Johnson ..... A43B 11/00 36/58.6
9,861,165 B2 * 1/2018 Schneider ..... A43B 13/14
10,165,831 B2 * 1/2019 Tsai ..... A43C 9/02
10,791,798 B2 * 10/2020 Lovett ..... A43C 1/00
2002/0095750 A1 7/2002 Hammerslag
2003/0041478 A1 * 3/2003 Liu ..... A43C 7/00 36/50.1
2003/0150135 A1 * 8/2003 Liu ..... A43B 11/00 36/50.1
2003/0204938 A1 * 11/2003 Hammerslag ..... A43C 11/004 24/68 SK
2005/0160627 A1 7/2005 Dalgaard et al.
2007/0240334 A1 * 10/2007 Johnson ..... A43C 11/16 36/50.1
2007/0261270 A1 * 11/2007 Nadel ..... A43C 11/165 36/50.5
2008/0301919 A1 * 12/2008 Ussher ..... A43B 3/34 24/712.7
2008/0307673 A1 * 12/2008 Johnson ..... A43C 11/165 36/50.1
2013/0086816 A1 * 4/2013 Johnson ..... A43C 11/00 36/83
2013/0104429 A1 * 5/2013 Torres ..... A43C 1/003 36/136
2014/0068838 A1 * 3/2014 Beers ..... A43C 1/00 2/243.1
2014/0070042 A1 * 3/2014 Beers ..... B65H 59/384 242/413
2015/0250268 A1 * 9/2015 Alt ..... A43C 11/165 24/68 SK
2015/0289594 A1 * 10/2015 Rushbrook ..... A43B 17/00 12/142 T
2015/0289595 A1 * 10/2015 Rushbrook ..... A43C 11/008 36/50.1
2015/0289596 A1 * 10/2015 Beers ..... A43C 11/00 36/50.1
2016/0157561 A1 * 6/2016 Schum ..... A43B 3/34 242/390
2016/0262485 A1 * 9/2016 Walker ..... A61B 5/6807
2016/0286900 A1 * 10/2016 Parker ..... A43C 7/00
2017/0105489 A1 * 4/2017 Lovett ..... A43C 11/20
2017/0156447 A1 * 6/2017 Guest ..... A43B 13/181
2017/0265573 A1 * 9/2017 Beers ..... A43B 3/34
2017/0265577 A1 * 9/2017 Schneider ..... A43B 11/00
2017/0265579 A1 * 9/2017 Schneider ..... A43B 3/36
2017/0265581 A1 * 9/2017 Chang ..... A43C 7/00
2017/0265585 A1 * 9/2017 Orand ..... A43C 11/008
2017/0265586 A1 * 9/2017 Schneider ..... A43C 1/00
2017/0265591 A1 * 9/2017 Schneider ..... B65H 59/00
2017/0265593 A1 * 9/2017 Schneider ..... B65H 69/00
2017/0265594 A1 * 9/2017 Walker ..... G01L 1/12
2017/0267485 A1 * 9/2017 Schneider ..... A43C 7/00
2017/0272008 A1 * 9/2017 Schneider ..... A43C 11/165
2017/0303643 A1 * 10/2017 Converse ..... A61C 7/026
2017/0354206 A1 12/2017 Hammerslag et al.
2018/0116326 A1 * 5/2018 Beers ..... A43B 3/34
2018/0116342 A1 * 5/2018 Hopkins ..... A43C 1/06
2018/0125168 A1 * 5/2018 Beers ..... A43C 11/165
2018/0153263 A1 * 6/2018 Beers ..... A43C 7/08
2018/0168259 A1 * 6/2018 Kim ..... A43C 11/16
2018/0199671 A1 * 7/2018 Schneider ..... A43C 7/06
2018/0199673 A1 * 7/2018 Schneider ..... A43C 7/06
2018/0199674 A1 * 7/2018 Walker ..... A43B 3/36
2018/0219403 A1 * 8/2018 Schneider ..... H02J 50/10
2018/0343978 A1 * 12/2018 Stillman ..... F16H 1/2863

FOREIGN PATENT DOCUMENTS

| | | |
|---|---|---|
| CN | 204467098 | 7/2015 |
| CN | 206675098 U | 11/2017 |
| CN | 108135330 A | 6/2018 |
| CN | 112822954 | 5/2021 |
| CN | 112822954 | 12/2022 |
| DE | 29814659 | 10/1998 |
| JP | 2015000297 | 1/2015 |
| JP | 2016039921 | 3/2016 |
| KR | 20120139220 | 12/2012 |
| KR | 20150131485 | 11/2015 |
| TW | 201141410 | 12/2011 |
| WO | 2020047450 | 3/2020 |

OTHER PUBLICATIONS

"European Application Serial No. 19856247.2, Office Action dated Apr. 13, 2021", 2 pgs.
"International Application Serial No. PCT US2019 049124, International Search Report dated Dec. 20, 2019", 3 pgs.
"International Application Serial No. PCT US2019 049124, Written Opinion dated Dec. 20, 2019", 5 pgs.
"International Application Serial No. PCT US2019 049124, International Preliminary Report on Patentability dated Mar. 11, 2021", 7 pgs.
"Chinese Application Serial No. 201980065867.6, Office Action dated Feb. 18, 2022", w/English translation, 17 pgs.
"European Application Serial No. 19856247.2, Extended European Search Report dated Apr. 21, 2022", 5 pgs.
"Chinese Application Serial No. 201980065867.6, Response filed Jun. 20, 2022 to Office Action dated Feb. 18, 2022", w/ English claims, 7 pgs.
"Chinese Application Serial No. 201980065867.6, Response filed Sep. 6, 2022 to Office Action dated Jul. 7, 2022", w/ English claims, 9 pgs.
"Chinese Application Serial No. 201980065867.6, Office Action dated Jul. 7, 2022", With English translation, 10 pgs.
"European Application Serial No. 19856247.2, Response filed Nov. 9, 2022 to Extended European Search Report dated Apr. 21, 2022", 3 pgs.

* cited by examiner

AUTOLACING FOOTWEAR HAVING A NOTCHED SPOOL

PRIORITY APPLICATIONS

This application claims the benefit of priority to U.S. Provisional Patent Application Ser. No. 62/725,677, filed Aug. 31, 2018, the content of which is incorporated herein by reference in its entirety.

TECHNICAL FIELD

The subject matter disclosed herein generally relates to an article of footwear having an autolacing motor and a notched spool member.

BRIEF DESCRIPTION OF THE DRAWINGS

Some embodiments are illustrated by way of example and not limitation in the figures of the accompanying drawings.

DETAILED DESCRIPTION

Example methods and systems are directed to an article of footwear having an autolacing motor and a notched spool. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

Articles of footwear, such as shoes, may include a variety of components, both conventional and unconventional. Conventional components may include an upper, a sole, and laces or other securing mechanisms to enclose and secure the foot of a wearer within the article of footwear. Unconventionally, a motorized lacing system may engage with the lace to tighten and/or loosen the lace. Additional or alternative electronics may provide a variety of functionality for the article of footwear, including operating and driving the motor, sensing information about the nature of the article of footwear, providing lighted displays and/or other sensory stimuli, and so forth.

In general, and particularly for articles of footwear oriented toward the performance of athletic activities, characteristics such as the size, form, robustness, and weight of the article of footwear may be of particular importance. The capacity to firmly secure the article of footwear to the foot by way of tightening a lace, laces, or other tension members may further enhance wearability, comfort, and performance. Providing desired tightness across a desired range of the upper of a footwear may be a particular challenge of autolacing footwear and footwear in general.

Autolacing footwear has been developed that utilizes a spool with notches that allows the apparent length of two segments of a lace to be adjusted. The lace may have securing members, such as tied or knotted portions of the lace, that may be seated and secured within one of the notches. Dependent on which of the notches the securing member is positioned in, the apparent length of the lace segments may be increased or decreased, respectively. The result of the changes in the apparent length of the two segments may result in a different tension on different sides of the lace and, as a result, a different fit of the article of footwear.

Figure 1:
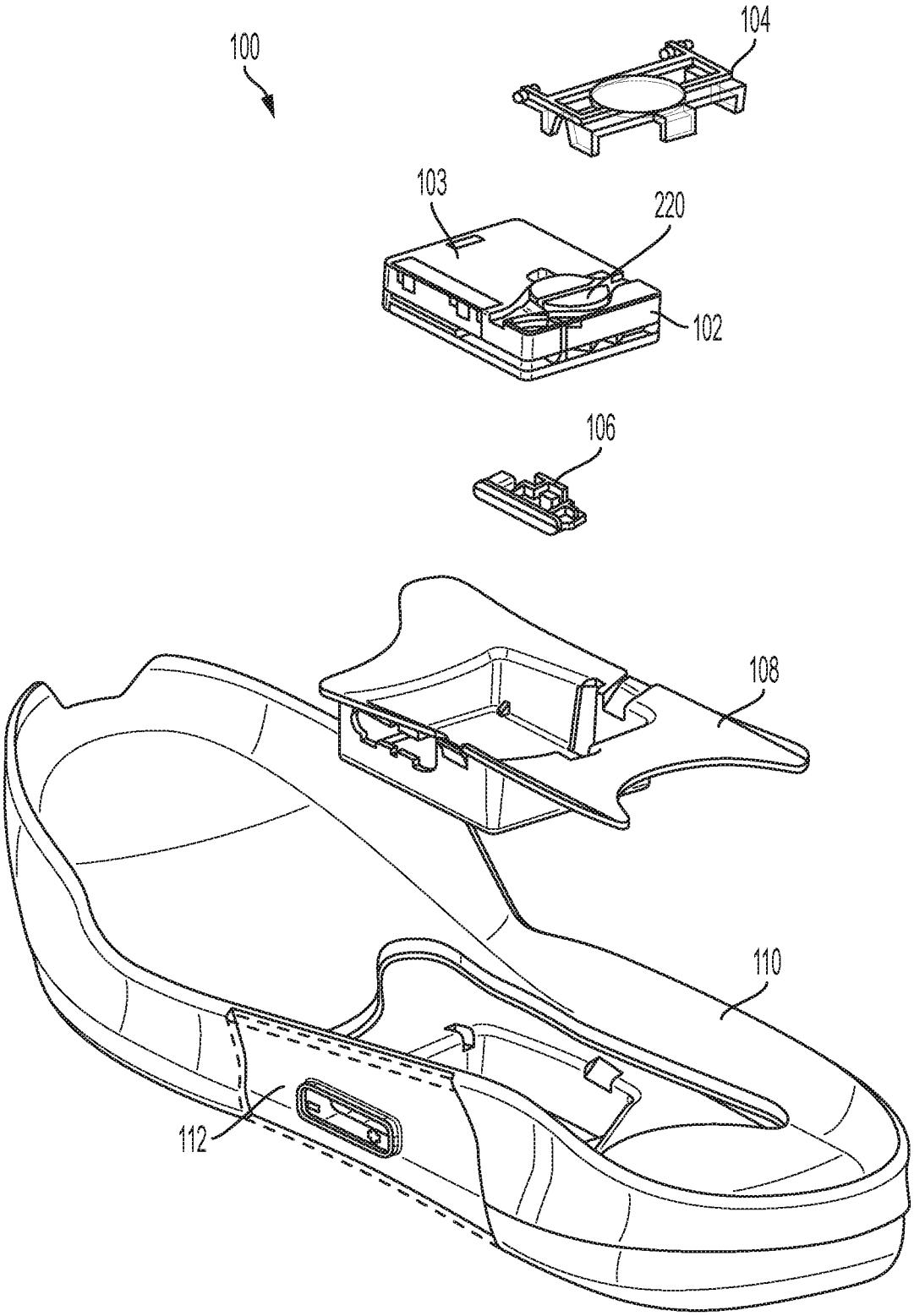
FIG. 1 is an exploded view illustration of components of a motorized lacing system for an article of footwear, in an example embodiment.

FIG. 1 is an exploded view illustration of components of a motorized lacing system for an article of footwear, in an example embodiment. While the system is described with respect to the article of footwear, it is to be recognized and understood that the principles described with respect to the article of footwear apply equally well to any of a variety of wearable articles. The motorized lacing system 100 illustrated in FIG. 1 includes a lacing engine 102 having a housing structure 103, a lid 104, an actuator 106, a mid-sole plate 108, a mid-sole 110, and an outsole 112. FIG. 1 illustrates the basic assembly sequence of components of an automated lacing footwear platform. The motorized lacing system 100 starts with the mid-sole plate 108 being secured within the mid-sole. Next, the actuator 106 is inserted into an opening in the lateral side of the mid-sole plate opposite to interface buttons that can be embedded in the outsole 112. Next, the lacing engine 102 is dropped into the mid-sole plate 108. In an example, the lacing system 100 is inserted under a continuous loop of lacing cable and the lacing cable is aligned with a spool in the lacing engine 102 (discussed below). Finally, the lid 104 is inserted into grooves in the mid-sole plate 108, secured into a closed position, and latched into a recess in the mid-sole plate 108. The lid 104 can capture the lacing engine 102 and can assist in maintaining alignment of a lacing cable during operation. A lace spool 220 (see FIG. 2) is under the lid 104.

Figure 2:
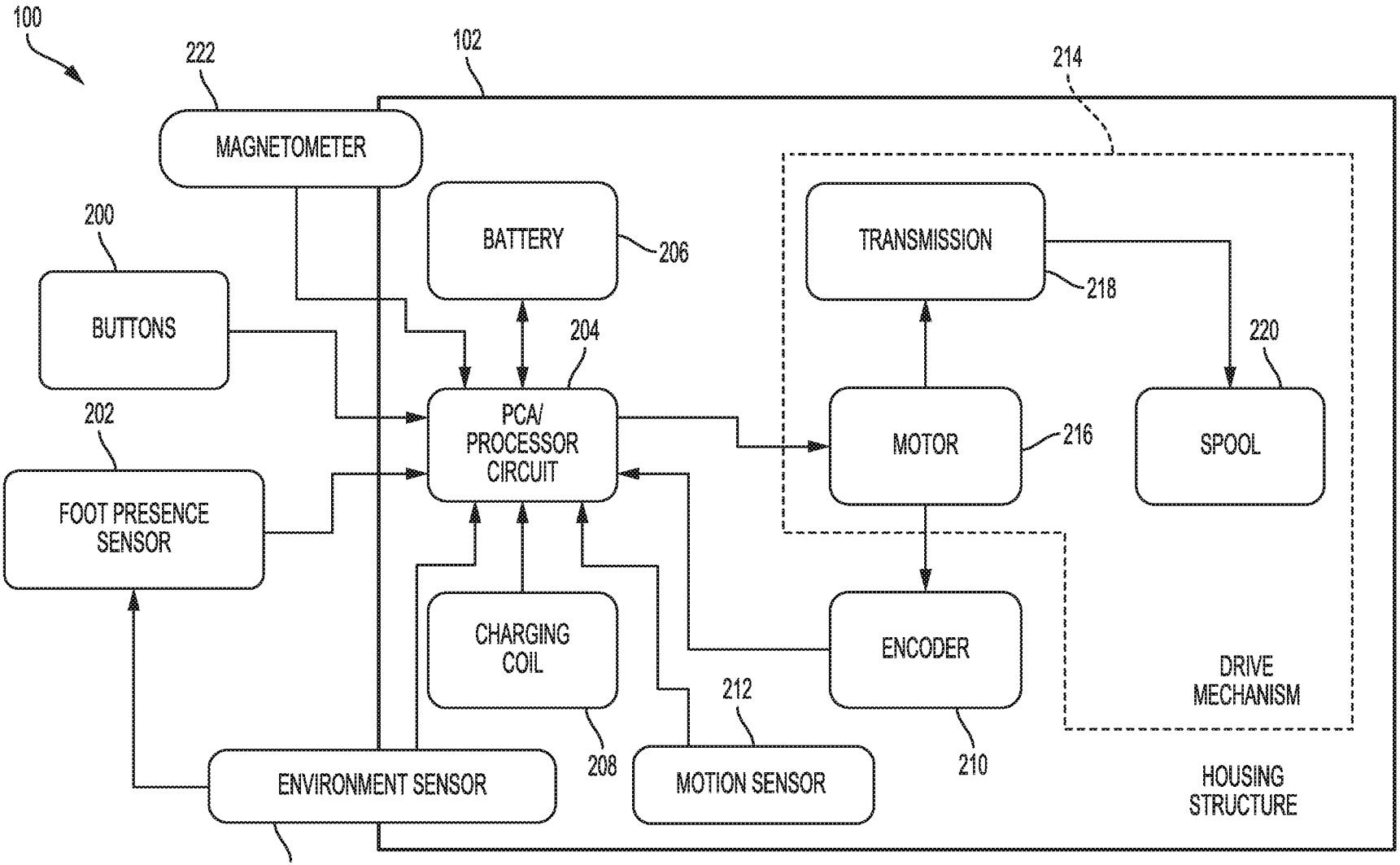
FIG. 2 illustrates generally a block diagram of components of a motorized lacing system, in an example embodiment.

FIG. 2 illustrates generally a block diagram of components of a motorized lacing system 100, in an example embodiment. The system 100 includes some, but not necessarily all, components of a motorized lacing system such as including interface buttons 200, a foot presence sensor 202, and the lacing engine housing 102 enclosing a printed circuit board assembly (PCA) with a processor circuit 204, a battery 206, a receive coil 208, an optical encoder 210, a motion sensor 212, and a drive mechanism 214. The optical encoder 210 may include an optical sensor and an encoder having distinct portions independently detectable by the optical sensor. The drive mechanism 214 can include, among other things, a motor 216, a transmission 218, and a lace spool 220. The motion sensor 212 can include, among other things, a single or multiple axis accelerometer, a magnetometer, a gyrometer, or other sensor or device configured to sense motion of the housing structure 102, or of one or more components within or coupled to the housing structure 102. In an example, the motorized lacing system 100 includes a magnetometer 222 coupled to the processor circuit 204.

In the example of FIG. 2, the processor circuit 204 is in data or power signal communication with one or more of the interface buttons 200, foot presence sensor 202, battery 206, receive coil 208, and drive mechanism 214. The transmission 218 couples the motor 216 to a spool to form the drive mechanism 214. In the example of FIG. 2, the buttons 200, foot presence sensor 202, and environment sensor 224 are shown outside of, or partially outside of, the lacing engine 102.

In an example, the receive coil 208 is positioned on or inside of the housing 103 of the lacing engine 102. In various examples, the receive coil 208 is positioned on an outside major surface, e.g., a top or bottom surface, of the housing 103 and, in a specific example, the bottom surface. In various examples, the receive coil 208 is a qi charging coil, though any suitable coil, such as an A4WP charging coil, may be utilized instead.

In an example, the processor circuit 204 controls one or more aspects of the drive mechanism 214. For example, the processor circuit 204 can be configured to receive information from the buttons 200 and/or from the foot presence sensor 202 and/or from the motion sensor 212 and, in response, control the drive mechanism 214, such as to tighten or loosen footwear about a foot. In an example, the processor circuit 204 is additionally or alternatively configured to issue commands to obtain or record sensor information, from the foot presence sensor 202 or other sensor, among other functions. In an example, the processor circuit 204 conditions operation of the drive mechanism 214 on (1) detecting a foot presence using the foot presence sensor 202 and (2) detecting a specified gesture using the motion sensor 212.

Information from the environment sensor 224 can be used to update or adjust a baseline or reference value for the foot presence sensor 202. As further explained below, capacitance values measured by a capacitive foot presence sensor can vary over time, such as in response to ambient conditions near the sensor. Using information from the environment sensor 224, the processor circuit 204 and/or the foot presence sensor 202 can update or adjust a measured or sensed capacitance value.

Figure 3:
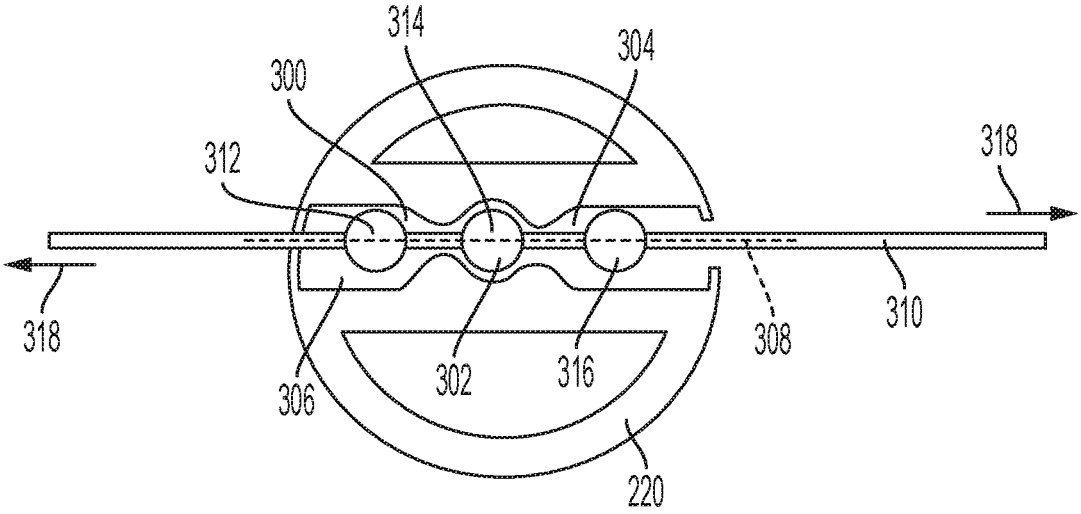
FIG. 3 is a top-view of the lace spool, in an example embodiment.

FIG. 3 is a top-view of the lace spool 220, in an example embodiment. The lace spool 220 includes three notches 300, 302, 304, extending along a channel 306 across a diameter 308 of the lace spool 220. A lace 310 includes securing members 312, 314, 316 configured to be seated and secured in the notches 300, 302, 304. In various examples, the securing members 312, 314, 316 are knots tied in the lace 310 or are distinct pieces attached or otherwise secured to the lace 310, such as spheres or other shapes made of metal, rubber, fabric, and the like that may be glued to, crimped around, or otherwise secured to the lace 310.

As will be illustrated herein, the securing members 312, 314, 316 may be shifted between and among the various notches 300, 302, 304 by exerting a lateral force 318 on the lace 310. When the lateral force 318 is sufficient to overcome the friction between the securing members 312, 314, 316 and the notches 300, 302, 304, as well as any other friction induced on the lace 310 generally, the securing members 312, 314, 316 may slip out of the notches 300, 302, 304 in which they are seated and travel, along with the lace 310 in general, in the direction of the lateral force 318.

Figure 4:
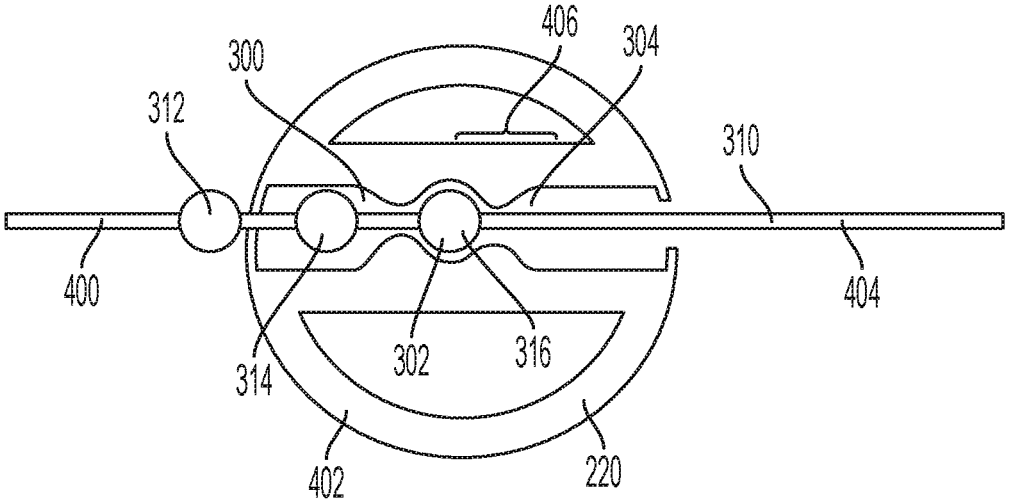
FIG. 4 is a top-view of the lace spool with the lace shifted in the lace spool, in an example embodiment.

FIG. 4 is a top-view of the lace spool 220 with the lace 310 shifted in the lace spool 220, in an example embodiment. In contrast to the configuration of FIG. 3, in which the securing members 312, 314, 316 are secured within notches 300, 302, 304, respectively, in FIG. 4 the securing member 312 is not seated in any of the notches 300, 302, 304 while the securing member 314, 316 are seated in the notches 300, 302. The notch 304 does not have any securing member 312, 314, 316 seated therein.

Consequently, by transitioning between the configuration of FIG. 3 to FIG. 4, the apparent length of two segments of the lace 310 change. A first segment 400 of the lace 310 extends from an edge 402 of the spool 220 while a second segment 404 of the lace 310 extends from the edge 402 of the spool 220 but on an opposite side of the spool 220 from that of the first segment 400. As depicted in FIG. 4, the lace 310 and, as a result, the first and second segments 400, 404, extend off of the image, though as will be illustrated in detail herein, the first segment 400 extends to a first end of the lace 310 while the second segment 404 extends to a second end of the lace 310.

In an example, when each of the securing members 312, 314, 316 are secured within notches 300, 302, 304, as in FIG. 3, the length of each of the first and second segments 400, 404 is one hundred fifty (150) millimeters. In the example of FIG. 4, the length of the first segment 400 is one hundred sixty (160) millimeters while the length of the second segment 404 is one hundred forty (140) millimeters. As such, in such an example, the distance 406 between each of the notches 300, 302, 304 is ten (10) millimeters.

It is to be recognized and understood, then, that by adjusting the lace 310 so that the securing member 316 is seated in the notch 300, while the notches 302 and 304 are empty and the securing members 312 and 314 are not secured in any notch would result in the first segment 400 having a length of one hundred seventy (170) millimeters and the second segment 404 having a length of one hundred thirty (130) millimeters. It is also to be recognized and understood that by adjusting the lace 310 in the opposite direction that second segment 404 would become longer than the first segment 400. Thus, by positioning the securing members 312 and 314 in the notches 302, 304, the second segment 404 would have a length of one hundred sixty (160) millimeters and the first segment 400 would have a length of one hundred forty (140) millimeters. By positing the securing member 312 in the notch 304, the second segment 404 would have a length of one hundred seventy (170) millimeters and the first segment 400 would have a length of one hundred thirty (130) millimeters.

The above lengths are presented for illustrative purposes and it is to be recognized and understood that any of a variety of lengths, including of the lace 310, of the size of the lace spool 220, and the spacing of the notches 300, 302, 304, may be implemented as appropriate. Moreover, while three notches 300, 302, 304 and three securing members 312, 314, 316 are illustrated, any number of notches and securing members may be implemented as desired. It is further noted that the number of notches does not necessarily need to be the same as the number of securing members, and that in various examples an unequal number of notches and securing members are contemplated.

For instance, a single securing member may be implemented on the lace 310 and five notches may be implemented on the lace spool 220. The notches may be spaced apart at a five-millimeter distances in order to provide greater granularity in the length of the segments 400, 404 than in the example implementation illustrated above. Different numbers of notches and securing members, and distance between notches and distances between securing members, are contemplated.

It is noted that while the examples provide include an odd number of notches and securing members, examples with an even number of notches are contemplated. In such examples, the number of securing members is even and the number of notches is odd, or vice versa, then the segments 400, 404 may not be configured to have equal lengths. Additionally, while the distances between notches and securing members are illustrated as being the same, varying distances between notches and between securing members are contemplated.

Figure 5:
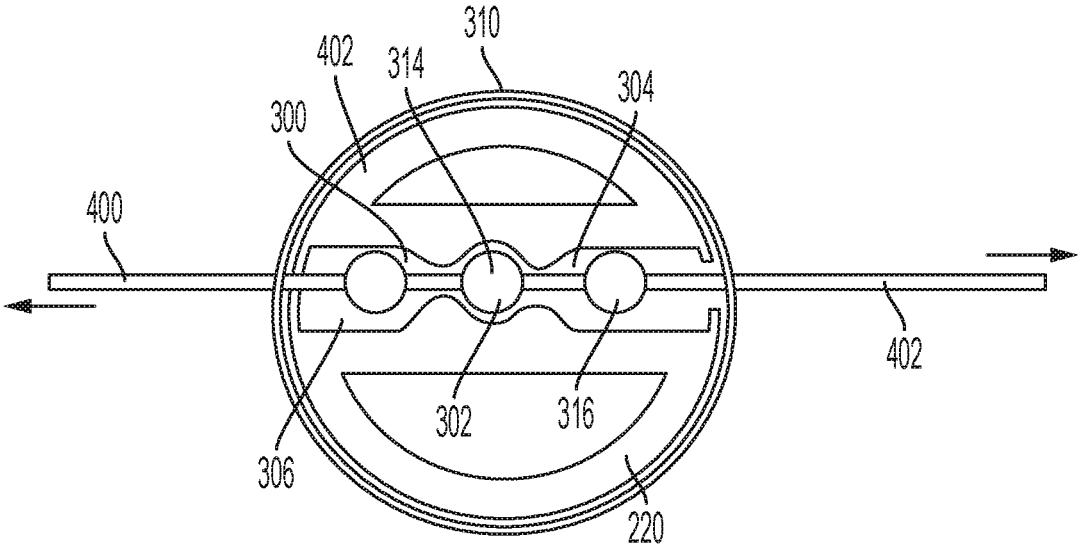
FIG. 5 is a depiction of the lace partially wound about the lace spool, in an example embodiment.

FIG. 5 is a depiction of the lace 310 partially wound about the lace spool 220, in an example embodiment. In such examples, the length of the segments 400, 404 is still judged on the basis of the lace 310 being unwound, as illustrated in FIGS. 3 and 4. Thus, because the securing members 312, 314, 316 are positioned in the notches 300, 302, 304, respectively and as illustrated in FIG. 3, the length of the first and second segments 400, 404 are still both one hundred fifty (150) millimeters, even though the portions of the first and second segments 400, 404 projecting from the lace spool 310 is less than one hundred fifty (150) millimeters. In an example, the apparent length of the first and second segments 400, 404 is the portion of the lace 310 extending past the edge 402 of the lace spool 220. Thus, in an illustrative example, the length of the first segment 400 may be one hundred fifty (150) millimeters while the apparent length of the first segment 400 that extends out of the lace spool 220 when the lace 310 is fully wound about the lace spool 220 is fifty (50) millimeters.

Figure 6:
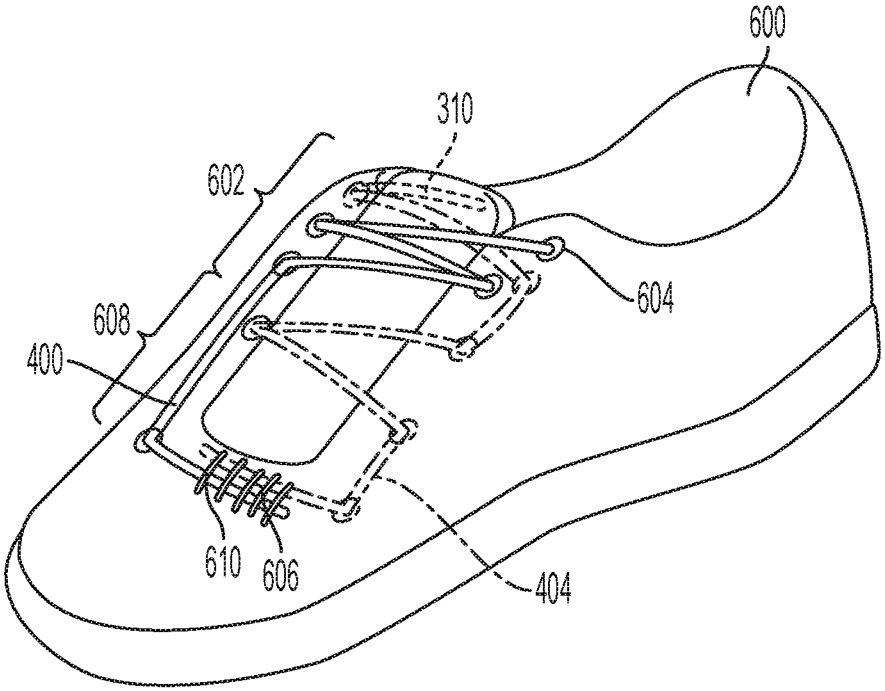
FIG. 6 is an image of an article of footwear including the motorized lacing system, in an example embodiment.

FIG. 6 is an image of an article of footwear 600 including the motorized lacing system 100, in an example embodiment. In the illustrated example, the first lace segment 400 creates a zig-zag pattern across a top region 602 of the upper 604 of the article of footwear 600 before a distal end 606 of the first segment 400 is secured at a lower region 608 of the upper 604. The second lace segment 404 crosses the top region 602 and then creates a zig-zag pattern across the lower region 608 of the upper 604 before being a distal end 610 of the second segment 404 is secured at the lower region 608.

The length of the first segment 400 is thus defined as the amount of lace 310 that extends from the edge 402 of the lace spool 220 (see FIG. 4) to the distal end 606 when the lace 310 is unwound from the lace spool 220, as illustrated in FIGS. 3 and 4. The apparent length of the first segment 400 is from the edge 402 of the lace spool 220 to the distal end 606 regardless of whether or not the lace 310 is spooled or unspooled. As such, the length and apparent length of the first segment 400 is the same if the lace 310 is unwound from the lace spool 220. The same principles apply to the length and apparent length of the second segment 404.

As such, adjustment of the position of the securing members 312, 314, 316 in the notches 300, 302, 304 changes how much tension is placed on the lace 310 in the top and lower regions 602, 608 and, as a result, how much the article of footwear 600 is secured to the foot of a wearer in the top and lower regions 602, 608. For instance, if the length of the first segment 400 is longer than the length of the second segment 404, as illustrated in FIG. 4, then the lace 310 will be looser in the top region 602 and more firm in the lower region 608. The degree of firmness/looseness between the regions 602, 608 may, consequently, be related to in which notches 300, 302, 304 the securing members 312, 314, 316 are positioned.

Figure 7:
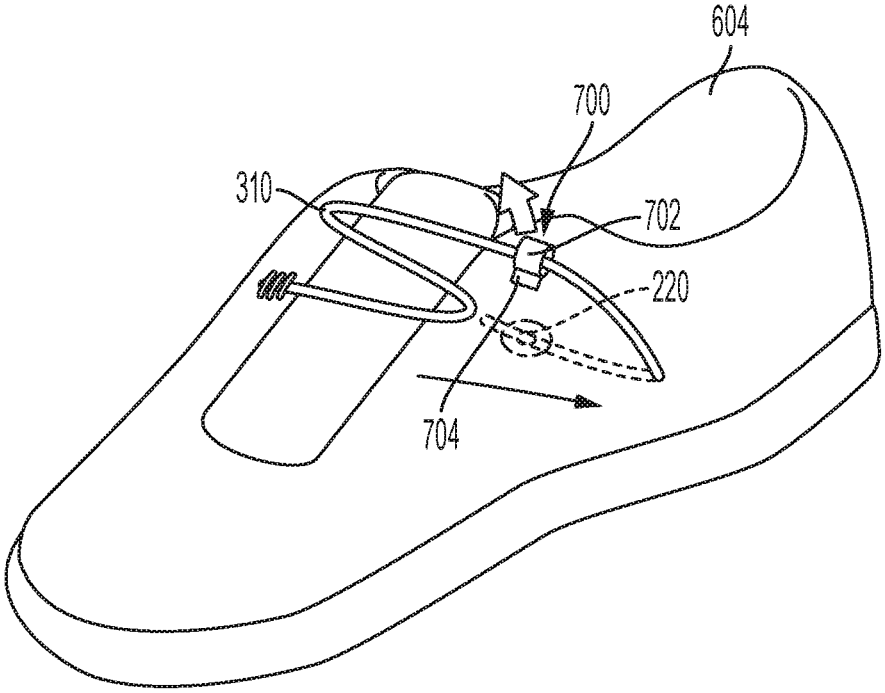
FIG. 7 is an image of the upper including a tab to adjust the notches and securing members, in an example embodiment.

FIG. 7 is an image of the upper 604 including a tab 700 to adjust the notches and securing members, in an example embodiment. The tab 700 forms a loop 702 which is secured at a securing region 704 to the upper 604, e.g., by being sewn, glued, and so forth. The lace 310 passes through the loop 702. By pinching the tab 700 so that the tab 700 grips the lace 310 so that the lace 310 does not significantly slip in the loop 702, the user may tug on the tab 700 and impart the lateral force 318 on the needed to shift the securing members 312, 314, 316 (not pictured) relative to the notches 300, 302, 304 (not pictured). A similar tab 700 on the other side of the upper 604 may allow for the lateral force 318 to be imparted in the other direction.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities. Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

What is claimed is:

1. An article of footwear, comprising: a midsole; an upper secured with respect to the midsole; a lace extending across the upper, the lace having a plurality of securing members, a first segment of the lace having a first apparent length and a second segment of the lace, separated from the first segment by at least one of the plurality of securing members, having a second apparent length; and a motorized lacing system positioned within the midsole, configured to engage with the lace to increase and decrease tension on the lace, the motorized lacing system comprising: a motor; and a spool, coupled to the motor, configured to spool and unspool the lace based on an operation of the motor, the spool having a plurality of notches, each of the plurality of notches configured to seat an individual one of the plurality of securing members, wherein the first apparent length and the second apparent length is adjustable based on which of the plurality of notches individual ones of the plurality of securing members are seated in, wherein the first and second apparent lengths are defined by which of the plurality of securing members are seated in ones of the plurality of notches.

2. The article of footwear of claim 1, wherein the spool is circular and forms a channel across a diameter of the spool, wherein the plurality of notches extend across along the channel.

3. The article of footwear of claim 2, wherein one of the plurality of securing members is configured to be shifted from a first one of the plurality of notches to a second one of the plurality of notches to change the first and second apparent lengths of the lace.

4. The article of footwear of claim 3, further comprising a loop, secured to the upper, through which the lace is threaded, configured to apply a lateral force on the lace to shift the one of the securing members from the first one of the plurality of notches to the second one of the plurality of notches.

5. The article of footwear of claim 4, wherein the loop is configured to apply the force upon being tugged by a user in a direction orthogonal to a run of the lace.

6. The article of footwear of claim 1, wherein the first and second apparent lengths are defined by which of the plurality of securing members are seated in ones of the plurality of notches.

7. The article of footwear of claim 1, wherein the plurality of securing members are a knots in the lace.

8. A motorized lacing system, comprising: a lace having a plurality of securing members, a first segment of the lace having a first apparent length and a second segment of the lace, separated from the first segment by at least one of the plurality of securing members, having a second apparent length; a motor; and a spool, coupled to the motor, configured to spool and unspool the lace based on an operation of the motor to increase and decrease tension on the lace, the spool having a plurality of notches, each of the plurality of notches configured to seat an individual one of the plurality of securing members, wherein the first apparent length and the second apparent length is adjustable based on which of the plurality of notches individual ones of the plurality of securing members are seated in, wherein the first and second apparent lengths are defined by which of the plurality of securing members are seated in ones of the plurality of notches.

9. The motorized lacing system of claim 8, wherein the spool is circular and forms a channel across a diameter of the spool, wherein the plurality of notches extend across along the channel.

10. The motorized lacing system of claim 9, wherein one of the plurality of securing members is configured to be shifted from a first one of the plurality of notches to a second one of the plurality of notches to change the first and second apparent lengths of the lace.

11. The motorized lacing system of claim 10, further comprising a loop, secured to the upper, through which the lace is threaded, configured to apply a lateral force on the lace to shift the one of the securing members from the first one of the plurality of notches to the second one of the plurality of notches.

12. The motorized lacing system of claim 11, wherein the loop is configured to apply the force upon being tugged by a user in a direction orthogonal to a run of the lace.

13. The motorized lacing system of claim 8, wherein the first and second apparent lengths are defined by which of the plurality of securing members are seated in ones of the plurality of notches.

14. The motorized lacing system of claim 8, wherein the plurality of securing members are knots in the lace.

* * * * *